US009411314B2

(12) United States Patent
Daout et al.

(10) Patent No.: US 9,411,314 B2
(45) Date of Patent: Aug. 9, 2016

(54) INTEGRAL ASSEMBLY OF A HAIRSPRING AND A COLLET

(71) Applicant: ROLEX S.A., Geneva (CH)
(72) Inventors: Jerome Daout, Rolle (CH); Richard Bossart, Lausanne (CH); Jean-Marc Bonard, Lausanne (CH)
(73) Assignee: ROLEX SA, Geneva (CH)

( * ) Notice: Subject to any disclaimer, the term of this patent is extended or adjusted under 35 U.S.C. 154(b) by 139 days.

(21) Appl. No.: 14/348,767

(22) PCT Filed: Oct. 1, 2012

(86) PCT No.: PCT/EP2012/069372
§ 371 (c)(1),
(2) Date: Sep. 19, 2014

(87) PCT Pub. No.: WO2013/045706
PCT Pub. Date: Apr. 4, 2013

(65) Prior Publication Data

US 2015/0023140 A1 Jan. 22, 2015

(30) Foreign Application Priority Data

Sep. 29, 2011 (EP) ..... 11405332

(51) Int. Cl.
*G04B 17/34* (2006.01)
*G04B 1/14* (2006.01)

(52) U.S. Cl.
CPC ..... *G04B 17/345* (2013.01); *G04B 1/14* (2013.01); *G04B 1/145* (2013.01); *Y10T 29/49579* (2015.01)

(58) Field of Classification Search
CPC ..... G04B 17/345; Y10T 29/49581; Y10T 403/70
USPC ..... 368/175–178, 128–133, 140, 144; 267/166–168
See application file for complete search history.

(56) References Cited

U.S. PATENT DOCUMENTS 3,896,614 A * 7/1975 Bachmann ..... G04B 18/02 368/170
7,077,562 B2 7/2006 Bourgeois et al.
(Continued)

FOREIGN PATENT DOCUMENTS

| | | | |
|---|---|---|---|
| CH | 492242 | A | 2/1970 |
| CH | 619467 | A4 | 2/1970 |
| CH | 499802 | A | 8/1970 |
| EP | 1422436 | A1 | 5/2004 |
| EP | 1513029 | A1 | 3/2005 |
| EP | 1655642 | A2 | 5/2006 |
| EP | 1818736 | A1 | 8/2007 |
| EP | 1826634 | A1 | 8/2007 |
| EP | 1835339 | A1 | 9/2007 |
| EP | 2003523 | A1 | 12/2008 |
| EP | 2104007 | A1 | 9/2009 |
| EP | 2151722 | A1 | 2/2010 |
| WO | 2011026725 | A1 | 3/2011 |

OTHER PUBLICATIONS

International Search Report, dated Apr. 5, 2013, in corresponding application No. PCT/EP2012/069372.

*Primary Examiner* — Edwin A. Leon
(74) *Attorney, Agent, or Firm* — Westerman, Hattori, Daniels & Adrian, LLP

(57) ABSTRACT

An integral assembly of a single or double hairspring and an unsplit collet including two portions opposite one another for receiving the balance staff, one portion including one of the bearing surfaces (2 or 3) for the balance staff and a point (10, 11) for attaching the hairspring, and the other portion including another bearing surface (4, 5 or 14) for the balance staff, the two portions being connected together by two linking portions that are less rigid than the receiving portions so as to be capable of elastically deforming during the fitting of a balance staff. According to another aspect, the invention also relates to an integral assembly of a hairspring and a collet, including at least two stages, as well as to a method for manufacturing such an assembly.

24 Claims, 8 Drawing Sheets

(56) References Cited

U.S. PATENT DOCUMENTS

| | | | | |
|---|---|---|---|---|
| 7,213,966 | B2 * | 5/2007 | Lambert | G04B 17/34 368/175 |
| 8,002,460 | B2 | 8/2011 | Daout et al. | |
| 8,025,782 | B2 | 9/2011 | Saucy | |
| 8,047,705 | B2 | 11/2011 | Hessler et al. | |
| 8,206,029 | B2 | 6/2012 | Vaucher et al. | |
| 8,393,783 | B2 | 3/2013 | Daout et al. | |
| 8,882,341 | B2 * | 11/2014 | Chu | G04B 17/345 368/177 |
| 2005/0281137 | A1 | 12/2005 | Bourgeois et al. | |
| 2006/0055097 | A1 | 3/2006 | Conus et al. | |
| 2007/0227893 | A1 | 10/2007 | Saucy | |
| 2009/0154303 | A1 | 6/2009 | Vaucher et al. | |
| 2010/0027382 | A1 | 2/2010 | Daout et al. | |
| 2010/0061192 | A1 | 3/2010 | Hessler et al. | |
| 2012/0106303 | A1 | 5/2012 | Von Gunten et al. | |

* cited by examiner

INTEGRAL ASSEMBLY OF A HAIRSPRING AND A COLLET

The invention relates to a collet. The invention also relates to an integrated single-blade or double-blade hairspring-non-split collet assembly which is intended to be driven onto a balance staff, notably to an integrated assembly including a collet according to the invention. Another aspect of the invention also deals with an integrated hairspring-collet assembly comprising at least two stages and to a method of manufacturing such an assembly.

BACKGROUND OF THE INVENTION

One of the critical points in using a hairspring in a high-precision clock movement is the reliability of the attachments (in settings) of the hairspring to the balance staff and to the balance bridge. In particular, the attachment of the hairspring to the balance staff is usually performed using a collet, which originally was a small split cylinder intended to be driven onto the balance staff and drilled laterally to receive the interior end of the actual hairspring proper. The development of micromanufacturing techniques, such as DRIE methods for silicon, quartz and diamond or UV-liga methods for Ni and NiP, have opened up options regarding the shapes and geometries used.

Silicon is a very advantageous material from which to make clock springs and micromanufacturing techniques allow the collet to be produced such that it is integral and manufactured as one with the hairspring. One potential problem is that silicon does not have a plastic deformation domain. The collet may thus soon break if the stresses exceed the maximum permissible stress and/or the elastic limit of the material. It is therefore necessary to be sure to dimension the collet both to hold the hairspring on the balance staff when the oscillator is operating (minimal tightening torque) and also so that the collet can be assembled with staffs the diameters of which may fluctuate, all this without breaking or suffering plastic deformation if the diameter of the balance staff remains within a given tolerance band.

Thus, there are various documents that disclose collet geometries.

European patent application published under no. EP 1 826 634 proposes, in its FIG. 4 in conjunction with line 34 of column 3, a collet comprising elastic zones consisting of curved arms. That document does not indicate where the hairspring is to be fixed.

European patent applications published under numbers EP 1 513 029 and EP 2 003 523 propose collets having a triangular opening. The hairspring is fixed in place at an attachment point (reference 3 in the figures of both documents) located at one of the vertexes of the triangles. The collet is formed of an external stiffening structure to which are attached flexible arms which deform to accommodate the balance staff.

European patent application published under no. EP 1 655 642 describes in its FIG. 10D a hairspring of a hairspring resonator having a collet the opening of which is circular. In this case, the balance is attached using rounded arms.

Also, patent application WO2011026275 discloses a hairspring-collet assembly with a collet having a bore provided with four circular bearing parts to receive the balance staff. The bearing parts are delimited by longitudinal grooves made in the bore of the collet.

The geometries described in these documents are not entirely satisfactory which means that many hairsprings (made of silicon, diamond, quartz, etc.) mounted on movements are equipped with a conventional collet which is then driven onto and/or bonded to the balance staff.

BRIEF DESCRIPTION OF THE INVENTION

It is an object of the invention to propose new collet geometries that are fully satisfactory, i.e. that make it possible to obtain the highest possible clamping torque on the balance staff and the lowest possible stress within the material. In addition, these collets need to be as well balanced as possible in order not to generate any imbalance, as this would impair the time keeping properties of the hairspring.

Such an object is achieved by means of an integrated single-blade or double-blade hairspring-non-split collet assembly, in which:

- the contour of the collet is a closed contour,
- the central opening of the collet which is intended to receive a balance staff is non-circular,
- the contour of the central opening of the collet comprises at least two bearing surfaces for a balance staff;

this integral assembly being distinguishable in that:

- the collet is formed of at least two balance staff receiving parts located facing one another notably at 180° from one another and one of which comprises at least the first of the bearing surfaces for the balance staff as well as a point of attachment or of insetting for the hairspring, and of which the other comprises at least the second of the bearing surfaces for the balance staff,
- these two balance staff receiving parts being connected to one another by two connecting parts which have a lower rigidity than the receiving parts so that they can deform elastically as a balance staff is driven in.

These features have the notable effect of preventing the point of attachment of the hairspring from moving significantly with respect to the points of contact with (of bearing against) the balance staff after the latter has been driven in. It then follows that the positioning of the hairspring and of its insetting point can be defined with precision.

Another aspect of the invention relates to an integrated single-blade or double-blade hairspring-collet assembly, it being possible for this collet to be split or non-split. This assembly has the particular feature of having at least two levels (or stages or parts), the hairspring being located on a different level from the level on which the bearing surfaces of the collet for the balance staff lie. This feature is particularly advantageous because it allows the retaining torque that holds the collet on the balance staff to be best optimized without requiring an increase in bulkiness in the plane of the hairspring. According to another aspect of the invention, this feature allows the point of attachment of the hairspring to be brought closer to the balance staff without being limited by the periphery of the collet.

The invention also relates to a method of manufacturing an integrated hairspring-split or non-split collet assembly, in which method the hairspring is produced on a different level from the level on which the bearing surfaces of the collet for the balance staff lie.

A collet according to the invention is defined as a collet comprising a bore intended to receive a balance staff, at least a first part and a second part, the first and second parts being separated by a plane perpendicular to the axis of the bore, an element for attaching the collet to a hairspring being exclusively located on the first part and an element for connecting the collet to the balance staff being essentially, or even exclusively, located on the second part.

Various embodiments of collets are defined as follows:

The collet as above, in which the attachment element or attachment point lies at a distance (D1) from the center of the collet that is less than half the diameter (D2) of a cylinder inside which the second part can be inscribed, notably at a distance (D1) less than or equal to the mean of half the diameter (D2) of the cylinder inside which the second part can be inscribed and half the diameter of the inscribed circle ($d_{max}$) inscribed inside a central opening of the collet.

The collet as above, in which the second part extends, along the axis of the bore, over a length greater than one times the thickness (E) of the hairspring, or even greater than 3 times the thickness (E) of the hairspring.

An integrated assembly according to the invention is defined as an integrated hairspring-collet assembly comprising:

a first receiving part, notably a nondeformable first receiving part, intended to bear against a balance staff, a second receiving part, notably a nondeformable second receiving part, intended to bear against the balance staff, a first connecting part, notably a deformable first connecting part, intended to connect the first and second receiving parts, a second connecting part, notably a deformable second connecting part, intended to connect the first and second receiving parts, and an element able continuously to surround the balance staff and comprising the receiving parts and the connecting parts.

Various embodiments of assemblies are defined as follows:

The integrated assembly as above, in which the connecting parts occupy 50% and more, or even between 50% and 90%, or even between 60% and 80%, of the total length of the exterior contour of the collet.

The integrated assembly as above, in which each connecting part occupies an angular sector measured from the center of the collet that is greater than or equal to 90°, or even comprised between 90° and 160°, or even comprised between 110° and 145°.

The integrated assembly as above, in which each connecting part has a portion distant from the balance staff by at least 0.5 times the radius of the balance staff, or even by at least 0.9 times the radius of the balance staff, once the assembly has been mounted on the balance staff.

The integrated assembly as above, in which each connecting part is loaded mainly in bending, once the integrated assembly has been mounted on the balance staff.

The integrated assembly as above, in which the receiving parts face one another, notably being at 180° from one another with respect to the center of the collet.

The integrated assembly as above, in which one blade of the hairspring is attached or connected directly to a receiving part, notably, in the case of an assembly comprising a double-blade hairspring, in which each blade is attached to a different receiving part.

The integrated assembly as above, in which a central opening of the collet intended to receive a balance staff is non-circular.

The integrated assembly as above, in which the contour of the central opening of the collet comprises, on one same receiving part, at least one bearing surface for the balance staff The integrated assembly as above, in which the contour of the central opening of the collet comprises, on one same receiving part, at least one pair of bearing surfaces for the balance staff, the tangents to the bearing surfaces at the points of contact of this pair making between them an angle ($\alpha$) greater than 90° and less than 170°.

The integrated assembly as above, in which the contour of the central opening of the collet comprises two pairs of bearing surfaces.

The integrated assembly as above, in which the bearing surfaces are at least partially located on arms or extensions extending from the body of the receiving parts.

The integrated assembly as above, in which bearing surfaces are planar or of negative curvature or of positive curvature with a radius greater than 0.51times the diameter ($d_{max}$) of the circle inscribed inside a central opening of the collet.

The integrated assembly as above, in which two receiving parts are positioned 180° apart with respect to the axis of the collet.

The integrated assembly as above, in which the various connecting parts have identical geometries and/or the various receiving parts have identical geometries.

The integrated assembly as above, in which the hairspring is a double-blade hairspring comprising a first blade of which the point of attachment to the collet is connected to a first receiving part and a second blade of which the point of attachment to the collet is connected to a second receiving part.

The integrated assembly as above, the geometry of the collet of which exhibits order 2 reflection symmetry.

The integrated assembly as above, the geometry of the collet of which exhibits order 2 rotational symmetry.

The integrated assembly as above, the assembly being made of silicon, possibly with an external layer and/or an internal layer of silicon oxide.

The integrated assembly as above, in which the attachment point(s) of the single-blade or double-blade hairspring is (are) closer to the central opening of the collet than is the contour of the collet.

The integrated assembly as above, the assembly being made of a fragile material or of a material that has no plastic deformation domain.

The integrated assembly as above, the assembly comprising a collet as above.

A method of manufacturing an assembly is defined as a method of manufacturing an integrated assembly as above, in which the hairspring is produced on a different part to the part on which the bearing surfaces via which the collet bears against the balance staff lie.

One way of carrying out the method of manufacturing an assembly is defined as the method of manufacture as above, in which the starting material used is an SOI wafer the layer of $SiO_2$ of which has a thickness greater than 3 microns.

A method of manufacturing a collet is defined as a method of manufacturing a collet as above, in which an element for attaching the collet to a hairspring is produced on a different part than the part on which an element for connecting the collet to the balance staff lies.

A method of carrying out the method of manufacturing a collet is defined as the method of manufacture as above, in which the starting material used is an SOI wafer the layer of $SiO_2$ of which has a thickness greater than 3microns.

An integrated assembly according to the invention is defined as an integrated hairspring-collet assembly made of a material that has no plastic deformation domain, in which:

the contour of the collet is a closed contour, the central opening of the collet which is intended to receive a balance staff is non-circular, the contour of the central opening of the collet comprises at least two bearing surfaces for a balance staff;

characterized in that the collet is formed of two balance staff receiving parts located facing one another and one of which comprises at least the first of the bearing surfaces for the balance staff as well as an attachment point for the hairspring, and of which the other comprises at least the second of the bearing surfaces for the balance staff, these two balance staff receiving parts being connected to one another by two connecting parts which have a lower rigidity than the receiving parts so that they can deform elastically as a balance staff is driven in.

Various embodiments of assemblies are defined as follows:

The integrated hairspring-collet assembly as above, in which the two connecting parts have a mean width less than the mean width of the receiving parts.

The integrated hairspring-collet assembly as above, in which the two connecting parts have a minimum width and/or a width midway between the receiving parts which is/are less than the maximum width of the receiving parts.

The integrated hairspring-collet assembly as above, in which the contour of the central opening of the collet comprises, on one same receiving part, at least one pair of bearing surfaces for the balance staff, the bearing surfaces of this pair making between them an angle ($\alpha$) greater than 90° and less than 170°.

The integrated hairspring-collet assembly as above, in which the contour of the central opening of the collet comprises two pairs of bearing surfaces.

The integrated hairspring-collet assembly as above, in which the bearing surfaces are at least partially located on arms.

The integrated hairspring-collet assembly as above, in which the connecting parts have identical geometries.

The integrated hairspring-collet assembly as above, in which the hairspring is a double-blade hairspring comprising a first blade of which the point of attachment to the collet is connected to a first receiving part and a second blade of which the point of attachment to the collet is connected to a second receiving part.

The integrated hairspring-collet assembly as above, the geometry of the collet of which exhibits order 2 reflection symmetry.

The integrated hairspring-collet assembly as above, the geometry of the collet of which exhibits order 2 rotational symmetry.

The integrated hairspring-collet assembly as above, this assembly being made of silicon, possibly with an external layer and/or a stage made of silicon oxide.

The integrated hairspring-collet assembly as above, formed on two levels, the hairspring being located on a different level from the level on which the bearing surfaces for the balance staff lie.

An integrated hairspring-collet assembly having at least two levels, the hairspring being located on a different level from that on which the bearing surfaces of the collet for a balance staff lie.

The integrated hairspring-collet assembly as above, in which the point(s) of attachment of the single or double-blade hairspring is (are) closer to the central opening of the collet than is the contour of the collet.

A method of manufacturing an integrated hairspring-collet assembly as above, in which the hairspring is produced on a different level from the level on which the bearing surfaces of the collet for the balance staff lie.

The method of manufacture as above, in which the starting material used is an SOI wafer the layer of $SiO_2$ of which has a thickness greater than 3 microns.

An oscillator according to the invention is defined as an oscillator comprising an integrated assembly as above and a balance staff of circular cross section.

A timepiece movement or a timepiece according to the invention is defined as a timepiece movement or a timepiece comprising an integrated assembly as above or comprising an oscillator as above, or comprising a collet as above.

Other features and advantages of the invention will now be described in detail in the following description which is given with reference to the attached figures which schematically depict:

FIG. 1: a collet according to the prior art EP 1 513 029 and EP 2 003 523;

FIG. 2: a collet of FIG. 10D of the prior art EP 1 655 642;

FIG. 3: a collet according to the prior art WO2011026725;

FIG. 4: an integrated double-blade hairspring-closed-contour collet assembly according to the invention;

FIGS. 5 to 7: other integrated double-hairspring-closed-contour collet assemblies according to the invention;

FIG. 8: the main steps in the method of obtaining an integrated double-blade hairspring-collet assembly according to a second aspect of the invention;

FIGS. 9 to 11: an integrated double-hairspring-collet assembly according to a second aspect of the invention;

FIGS. 12 and 13: other integrated double-blade hairspring-collet assemblies according to the second aspect of the invention;

FIG. 14: a graph showing the change in retaining torque M of the collets of the assemblies of FIGS. 12, 13 and 3 as a function of balance staff diameter;

FIG. 15: a graph showing the change in stress s in collets of the assemblies of FIGS. 12, 13 and 3 as a function of balance staff diameter;

FIGS. 16 to 17: a depiction of the stresses within the collets of the assemblies of FIGS. 12 and 13 once a balance staff has been driven into the opening (black: very small elastic deformation, stresses below half the maximum stress; gray: significant elastic deformation, stresses higher than half the maximum stress);

FIG. 18: a depiction of the rigid (black) and flexible (gray) zones for the collet of FIG. 12;

FIG. 19: an integrated double-blade hairspring-collet assembly according to an advantageous alternative form of the second aspect of the invention, in which assembly the points of attachment of the blades of the double-blade hairspring are close to the central opening;

FIG. 20: a view in cross section of a collet according to an advantageous alternative form of the second aspect of the invention;

FIG. 21: an integrated double-blade hairspring-collet assembly according to the first aspect of the invention, indicating the position of the insetting points; and FIG. 22: an integrated double-blade hairspring-collet assembly according to the second aspect of the invention, indicating the position of the insetting points.

DETAILED DESCRIPTION OF THE INVENTION

The invention applies both to assemblies having a single-blade hairspring and those having a double-blade hairspring. However, it is the latter that it suits the best.

What is meant by a "double-blade hairspring" is a hairspring comprising two blades wound in the same direction, but with a 180° offset, as described in patent application EP 2 151 722 A1. The respective internal ends of these blades are secured to the collet and their respective points of attachment are positioned symmetrically on opposite sides of the periphery of the collet.

Figure 21:
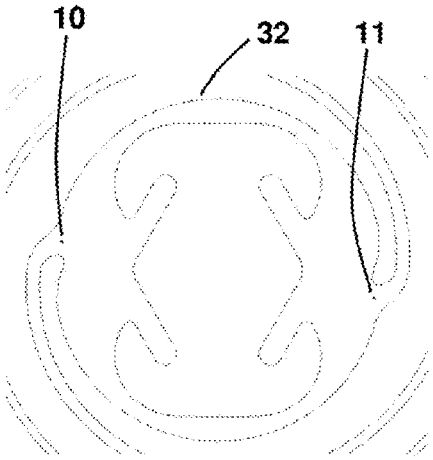
Figure 22:
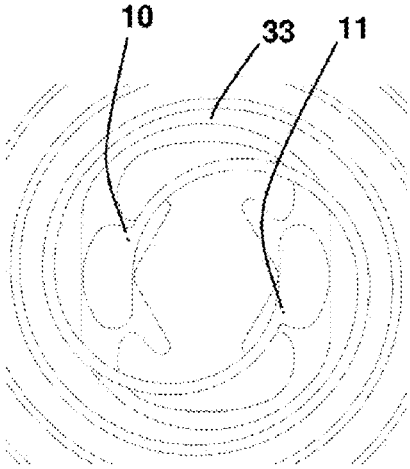

The "attachment point" or "insetting point" for the attachment or insetting of the hairspring is generally well defined in the case of a hairspring assembled on a collet made from a different material from the hairspring. In the case of an integrated collet-hairspring assembly for which the hairspring and the collet are manufactured as one, produced for example using a micromanufacturing technique from a silicon or "silicon-on-insulator" wafer, the insetting point may be defined as the point at which the local rigidity along the neutral axis reaches a value that is 10× higher than the rigidity of the blade of the hairspring. In the case of a hairspring of variable blade thickness, the minimum value of local rigidity along the blade will be considered. The local rigidity is equivalent to the flexural rigidity, determined when the blade is flexed or when the hairspring is in operation, over a portion of given length, for example 1 μm. The corresponding insetting points 10, 11 are indicated by way of example in the collet-hairspring assemblies of FIGS. 21 and 22. In the case of figure (which corresponds to the collet geometry of FIG. 12) it can be seen that the insetting point is located on the continuation of the external or peripheral contour 32 of the collet. In the case of FIG. 22 (which corresponds to the collet geometry of FIG. 19), it may be seen that the insetting point is located in close proximity to the balance staff, closer to the central opening of the collet than is the contour 33 at the level of the collet that does not comprise the hairspring.

The collets according to the invention are dimensioned both to keep the hairspring on the balance staff when the oscillator is in operation and also to be able to be assembled with staffs which have a certain spread on their diameter (no breaking or plastic deformation on the driving-in of a staff of a diameter falling within a given tolerance band). These collets normally have at least 2, and preferably 4, bearing surfaces for the balance staff.

According to the invention, the precise shape of the connecting parts is not crucial provided they are able to deform elastically, notably in bending, when a balance staff is being driven in. Under normal conditions of use of the collet, the receiving parts are therefore parts which are rigid or nondeformable and the connecting parts are therefore parts that are deformable, notably deformable in bending or flexible. The flexibility of these parts stems from the fact that they are thinner than the receiving parts. The deformable parts have smaller cross-sectional areas than the non-deformable parts. This thinning is performed, according to the invention, by making the deformable parts not as wide as the receiving parts. What is meant here by "width" is the thickness measured in the plane of the collet or, in other words, the distance between the contour of the collet and the contour of its central opening (for example, the minimum width e or e' or the width mid-way along the rigid receiving parts b or b' in FIGS. 12 and 13).

The junctions between the receiving parts and the connecting parts generally lie more or less at the base of a bearing surface (see hereinbelow and, by way of examples, FIG. 18 or FIG. 5 where they can each time be located on one side of the bulbous part 14). For preference, attempts are made to maximize the length of the connecting parts, and therefore to maximize the angular sector they occupy.

Figure 4:
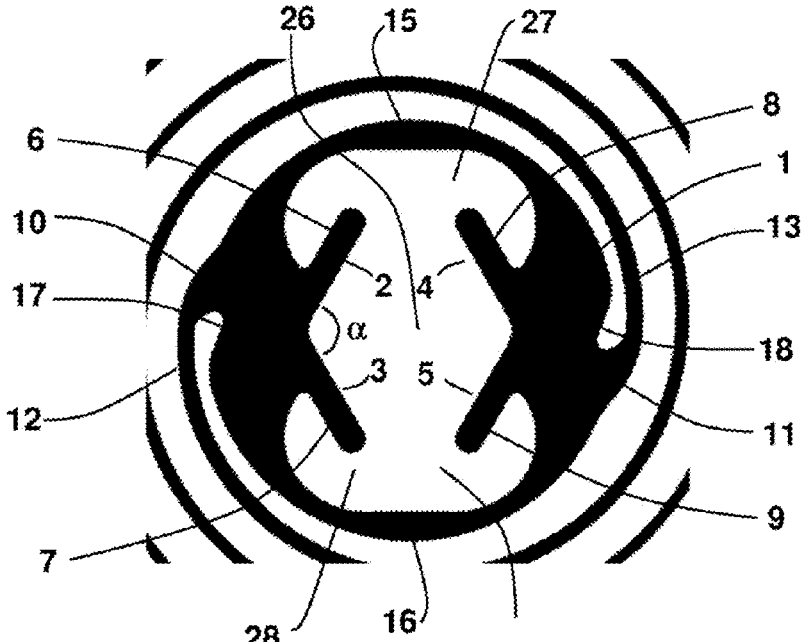

FIG. 4 depicts the central part of one example of an integrated double-blade hairspring-non-split collet assembly according to the invention.

As can be seen in FIG. 4, the collet 1, particularly the receiving parts 17, 18, comprises two pairs of bearing points 2, 3 and 4, 5 located on substantially planar arms 6, 7 and 8, 9 which are not elastic and are positioned in pairs near the points 10, 11 of attachment of the blades 12, 13 of the double-blade hairspring. The inelastic arms of one and the same pair protrude into the central opening of the collet and form between them an angle α which is preferably less than 170°, more preferably greater than 90° and less than 170°, and in this instance is around 120°. Each arm 6, 7, 8 or 9 has a free end.

The V-shape of the pairs of rigid arms has the effect of wedging the balance staff better than a single bearing point could. The important thing in fact is for the collet-staff insetting to be as firm as possible so that the points of contact between the collet and the balance staff do not move under the effect of the torque developed by the hairspring when the movement is in operation, i.e. during oscillations of the hairspring once the hairspring-collet assembly has been driven onto or assembled with a balance staff. Having a geometry with two receiving parts facing one another (notably 180° from one another) and each comprising a pair of bearing surfaces allows a vice-like action held by the flexible connecting parts. Under the effect of their elastic deformation, the connecting parts apply elastic return actions returning the receiving parts towards one another and each into contact with the balance staff. Nevertheless, it is also conceivable (but less favorable) to use a single bearing point, such as for example a contact surface that is planar, convex or concave with a radius of curvature greater than the radius intended for the balance staff.

In FIG. 4, the arms 6, 7, 8 and 9 and the corresponding bearing surfaces 2, 3, 4 and 5 are planar, i.e. their radius of curvature on the side of the central opening 26 is infinite. The bearing surfaces may also be convex, i.e. their radius of curvature may be negative on the side of the central opening 26, or may be concave, i.e. their radius of curvature may be positive on the side of the central opening 26.

However, in this last instance, the positive radius of curvature is strictly greater than 0.51 times the diameter $d_{max}$ of the largest circle that can be drawn inside the contour of the central opening (when the collet is not deformed, notably when it is not mounted on the balance staff), which circle is also referred to as the "inscribed circle" in the remainder of the description. For preference, the positive radius of curvature is greater than 0.62 times the diameter $d_{max}$, making it possible to define a single point of contact between the bearing part and the balance staff. A radius of curvature greater than 0.75 times, or even than 1 times, the diameter $d_{max}$ of the inscribed circle is also suitable. In the case of a balance staff of circular cross section, the diameter of the staff is slightly greater than $d_{max}$, for example comprised within a tolerance band of between 1.01 and 1.02 $d_{max}$.

It is important to plan for there to be no flexible part between the points of collet/balance staff contact and the point of attachment of the hairspring, so that the distance between the insetting point or attachment point and the bearing surfaces varies as little as possible and in particular does not vary substantially following the driving-in of the staff.

The collet 1 has order 2 rotational symmetry and has two axes of reflection symmetry, one formed by the bisector of the angle α, the other being perpendicular to the latter and located at equal distance from the intersection of the arms. It may be considered that it comprises two rigid balance staff receiving parts connected by two flexible connecting parts, as can be seen in FIG. 18 which will be detailed hereinbelow. The rigid parts 17 and 18 (in black in FIG. 18) are the parts from which the arms 6, 7 and 8, 9 and the blades 12 and 13 of the double-blade hairspring depart. The flexible parts 15 and 16 (in gray in FIG. 18) are connecting parts symmetrically connecting the rigid parts so as to form the collet 1 with its central opening. These flexible parts are thinner than the rigid parts and their elasticity or flexibility allows the collet 1 to be sure of deforming when it is being driven onto the balance staff while at the same time guaranteeing a minimum retention torque. In addition, the non-circular central opening allows the flexible parts to be off-centered and their length maximized.

The symmetry of the geometry of the collet of FIG. 4 is aimed at obtaining balance so that no imbalance is created. The non-circular central opening of the collet can be defined as comprising a central recess 26 for receiving the balance staff, delimited more or less by the 4 bearing surfaces 2, 3, 4 and 5, and two peripheral recesses 27, 28 formed substantially and symmetrically between the arms 6, 8 on the one hand and 7, 9 on the other, and the elastic parts 15 and 16. The recesses 27 and 28 are symmetric with respect to one another about the bisector of the angle $\alpha$.

Thus, the geometry makes it possible precisely to define the bearing points, of which there are four in the case of FIG. 4. The arms 6 to 9 make it possible precisely to define the bearing points of the collet on the balance staff, while at the same time maximizing the length of the flexible elastic parts. By contrast, these arms 6 to 9 do not flex or flex only negligibly, and cannot be considered to be elastic arms.

Figure 12:
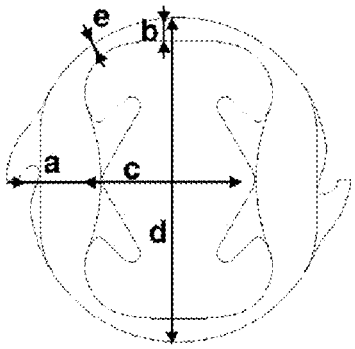
Figure 13:
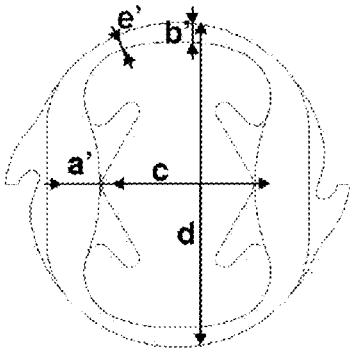
Figure 14:
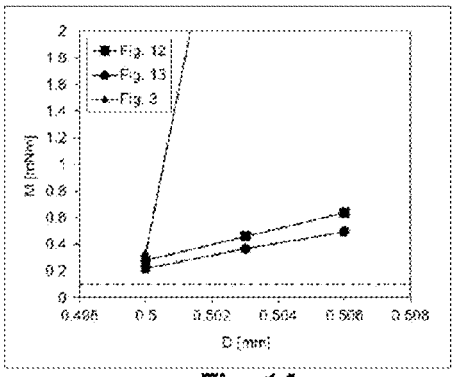
Figure 15:
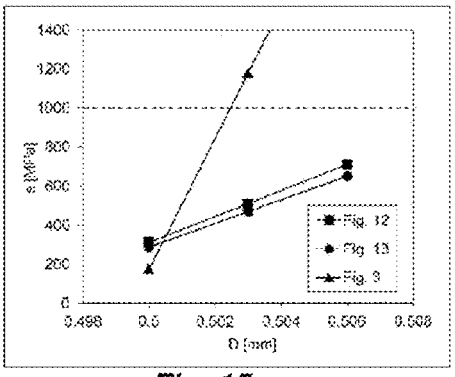
Figure 16:
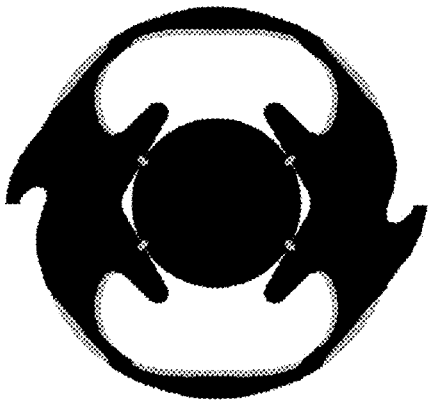
Figure 17:
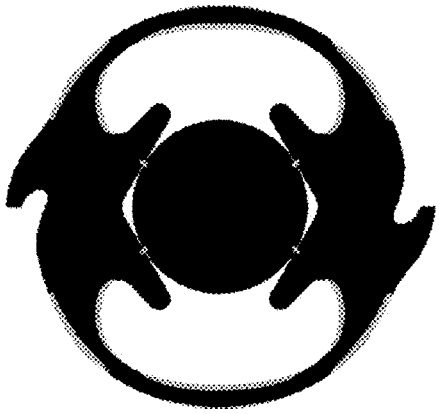

That much is confirmed by the numerical simulations reported in FIGS. 16 and 17 which indicate the levels of stress present when a balance staff with a nominal diameter of 0.503 mm is driven into two collets of different geometries depicted in FIGS. 12 and 13 (reference may also be made to FIGS. 14 and 15 which indicate the retaining torques and the maximum stresses for these collets for different staff diameters). The parts which suffer no or little elastic deformation, and which can be considered to be rigid, are indicated in black in FIGS. 16 and 17 (stress level below half the maximum stress reached following the driving of the staff, namely around 500 MPa in the case of FIGS. 16 and 17). The parts which are elastically deformed, and which can be considered to be flexible, are indicated in gray in those same figures (stress level higher than half the maximum stress). These numerical simulations show that the arms 6 to 9 bearing the bearing surfaces are not elastically deformed, unlike the flexible parts 15, 16. The distance between the bearing points and the points of attachment of the hairspring is thus always constant and perfectly defined.

Figure 18:
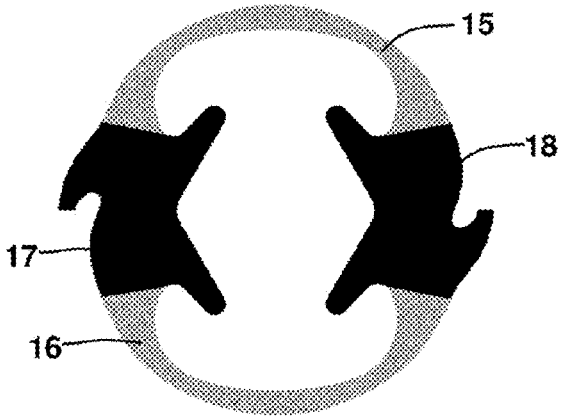

The collet is thus formed of two rigid balance staff receiving parts 17, 18 symbolized in black in FIG. 18, connected together by two flexible or elastic connecting parts 15, 16, symbolized in gray in FIG. 18. The advantage of this arrangement is that of maximizing the length of the flexible connecting parts while at the same time guaranteeing sufficiently high retaining torque on the balance staff, with a stress level that is markedly lower than the maximum permissible stress for the material. Simulations show that the collet according to the invention makes it possible to obtain a retaining torque (M) on the staff that is higher than can be achieved with flexible arms located inside a closed contour (for the same bulkiness). Using the theory of small deformations as applied to the case of a flexible beam, it is possible to show that the retaining torque M is dependent on the length of the flexible parts L, M being proportional to $L^3$. The longer the flexible parts, the higher the retaining torque. The advantage of the collet according to the invention is that it maximizes the length of the flexible parts. In the example of FIG. 18, the flexible parts occupy around 70% of the total length of the contour. For preference, the flexible parts occupy 50% or more of the total length of the contour, notably between 50% and 90%, more preferably between 60 and 80%. Alternatively, the angular sectors measured from the center of the collet (which corresponds to the center of the circle inscribed inside the central opening) and occupied by a rigid receiving part and by a flexible connecting part respectively, are around 54° and 126°. For preference, the angular sector measured from the center of the collet and occupied by a flexible connecting part is greater than or equal to 50°, notably comprised between 90° and 160°, more preferably between 110° and 145°. This angular sector is, for example, defined as being the smallest continuous angular sector between two receiving parts where there is a zone where the stress in the material is higher than 50% of the maximum stress level reached upon the driving of the staff.

Figure 5:
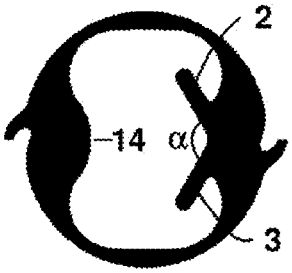

Another embodiment of the invention is depicted in FIG. 5. In this figure, the collet has just one pair of inelastic arms 2, 3. Facing the V formed by these arms, on the other side of the non-circular central opening there is a bulbous part 14 intended to act as a third bearing surface for the balance staff. The geometry here has just one symmetry of reflection about the bisector of the angle $\alpha$ (disregarding the point of attachment of the blades of the hairspring). The shape and dimensions of the bulbous part 14 are chosen to balance the collet as far as possible. Alternatively, the third bearing surface may also be planar or even concave, with a radius of curvature strictly greater than 0.51 times, preferably greater than 0.62, 0.75 or 1 times the inscribed diameter $d_{max}$.

Figure 1:
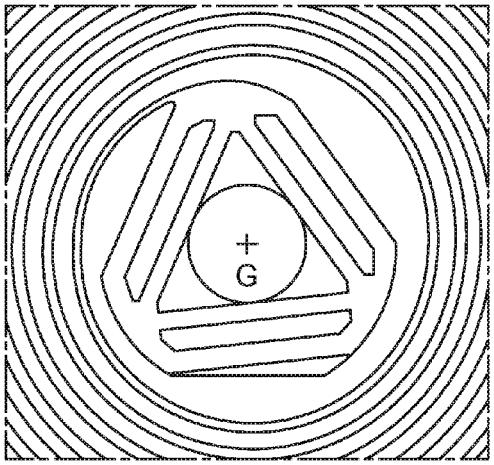
Fig. 1 (Prior art)
FIG. 1 depicts the collet proposed in the aforementioned European patent applications EP 1 513 029 and EP 2 003 523.
Figure 2:
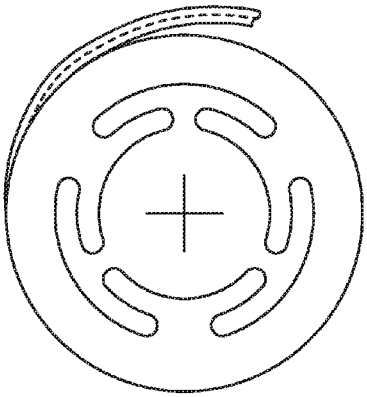
Fig. 2 (Prior art)
FIG. 2 depicts the collet described in FIG. 10 D of the aforementioned European patent application EP 1 655 642.

The collet according to the invention is particularly suited to fixing a double-blade hairspring to a balance staff. Specifically, most known collets of the prior art do not deform symmetrically with respect to the attachment points. With a collet like the one depicted in FIG. 1, one of the blades will be fixed to the same point as the blade of the single-blade hairspring depicted, namely to the vertex of the triangle formed by the stiffening structure. The second blade needs to have an attachment point located 180° from the first, namely opposite, in the middle of one side of the triangle. The movement of the attachment points with respect to the center of the hairspring and/or to the external attachments following the driving operation would therefore not be equivalent for the two attachment points, and this would impair the time keeping performance. In addition, the point of insetting of the second blade would be liable to deform as the hairspring expanded and contracted, likewise detracting from the time keeping performance.

Second Aspect of the Invention

Another aspect of the invention relates to a collet having at least two levels or stages or parts. The hairspring attachment or anchor point (or attachment points in the case of a two-blade hairspring) is therefore located on a different level from the level on which most, or even the entirety, of the bearing surfaces lie. This is applied in particular to an integrated hairspring-collet assembly.

What happens is that the inventors have discovered that it was possible to maximize the torque withstand of the collet, while minimizing its bulkiness, by lengthening the collet in the plane perpendicular to the hairspring. That allows the function of attaching the hairspring to the staff via the collet (first level, in the plane of the hairspring) to be dissociated from the function of holding onto the staff, notably of holding the collet on the staff (first and second level, and preferably exclusively on the second level, outside of the plane of the hairspring), while at the same time distributing the elastic stress in as balanced a way as possible along the flexible parts.

Figure 9:
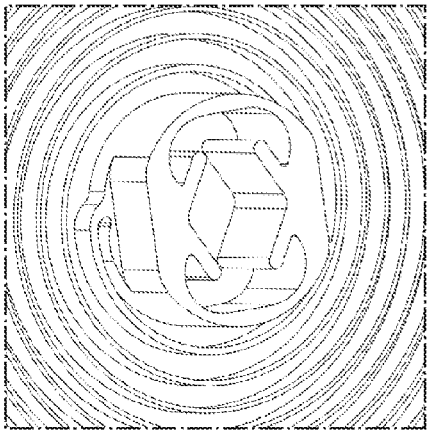
Figure 10:
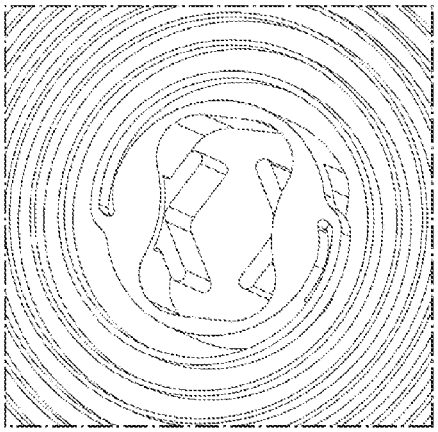

An integrated hairspring-collet assembly corresponding to that of FIG. 4 produced on two levels is depicted in front and rear perspective in FIGS. 9 and 10.

As may be seen from those figures, the flanges are not perfectly superposed; there is an offset of a few microns between the first and the second layer.

Figure 11:
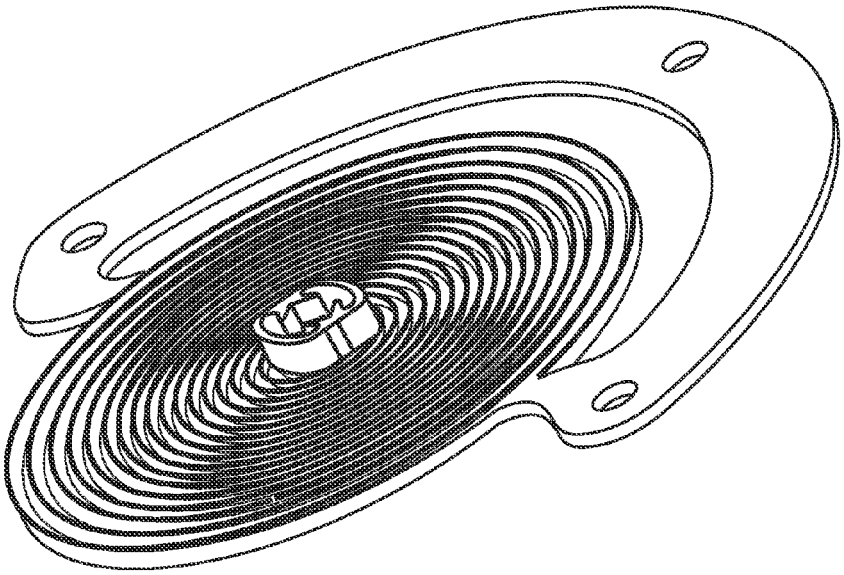

FIG. 11 depicts the entirety of the hairspring assembly according to FIGS. 9 and 10, with the external ends of the blades of the double-blade hairspring secured to a fixing element intended to be connected to the movement of a timepiece.

It is obvious that such an integrated hairspring-collet assembly produced on two levels can also be applied to other types of collets, notably to split collets, and to other types of hairspring, notably to single-blade hairsprings.

Method of Manufacture

The collet or the hairspring-collet assembly can be manufactured using known methods, such as the method covered by patent application no. EP 1 655 642. The collet or the hairspring-collet assembly according to the second aspect of the invention can be manufactured using known methods, such as those covered by patent applications no. EP 1 835 339 or EP 2 104 007.

Figure 8:
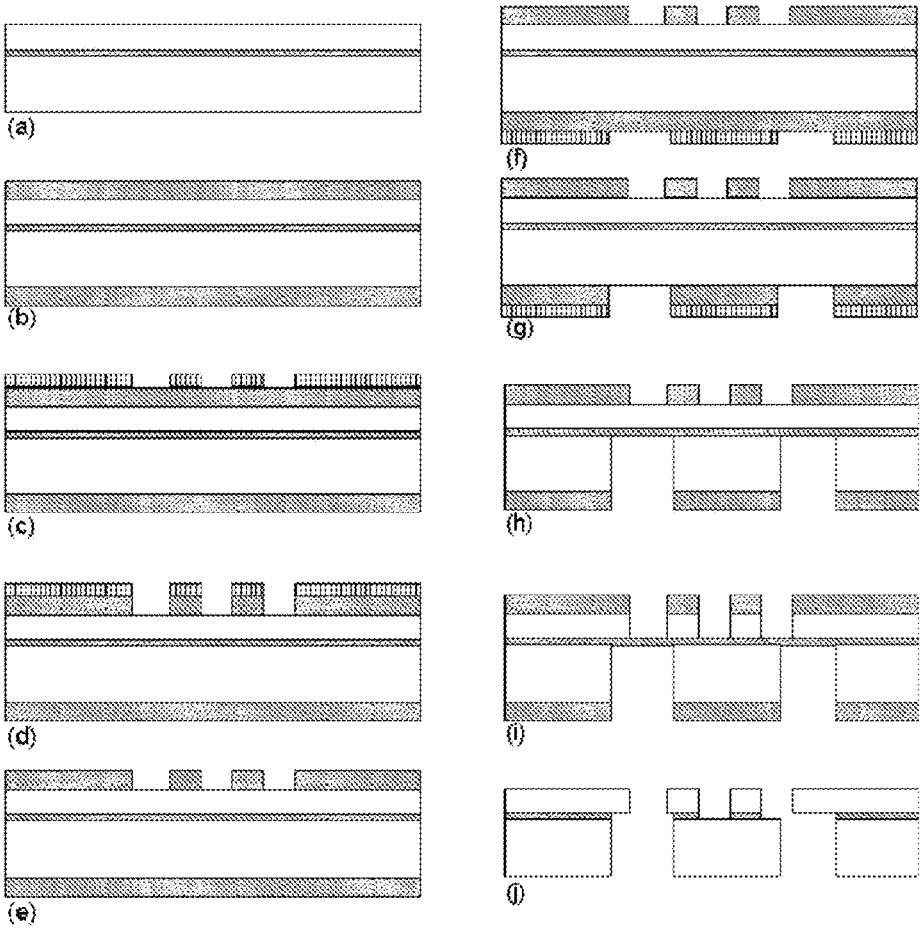

The main steps in a method of manufacturing a collet or an integrated hairspring-collet assembly produced on two levels, stages or parts are depicted in FIG. 8.

The starting substrate used is a wafer of the "SOI" (silicon-on-insulator) type, made up of two parts of monocrystalline Si separated by a thin layer of silicon oxide $SiO_2$ (FIG. 8*a*, with the monocrystalline Si shown in white and the $SiO_2$ in oblique hatching). After an initial cleaning, the wafer is oxidized to form a surface layer of $SiO_2$ on each side of the substrate (FIG. 8*b*) which layer will act as a mask for deep reactive ion etching (DRIE). A photolithography operation is then performed on a first face to define a first pattern in photosensitive resin (FIG. 8*c*, the resin being depicted in straight hatching) and this pattern is reproduced in the underlying oxide layer by dry etching (FIG. 8*d*). After a cleaning (FIG. 8*e*) the same steps are repeated on the second face with a second pattern: a photolithography operation makes it possible to define a second pattern in photosensitive resin (FIG. 8*f*), which is reproduced in the underlying oxide layer using dry etching (FIG. 8*g*). A deep reactive ion etching step is then carried out on the second face to etch the pattern into the second layer of Si (FIG. 8*h*). Deep reactive ion etching is then carried out on the first layer (FIG. 8*i*). The exposed parts of $SiO_2$ (external layers and central layer) are finally dissolved by BHF (buffer HF, namely a mixture of HF and of $NH_4F$ which acts as a buffer to stabilize the rate of attack; FIG. 8*j*) attack.

Various steps in addition to the methods explained hereinabove may be provided, for example (and nonlimitingly):

- the depositing of functional layers (oxides, nitrides, carbon-based layers) on all or part of the surface, for example using techniques of the PVD, CVD or ALD type;
- the depositing of an oxide layer of $SiO_2$ to thermally compensate the hairspring oscillator according to EP 1 422 436;
- the creation of part of the structure, for example the arms 6, 7, 8 and 9, from metal or metal alloy using an electroforming technique of the LiGA type.

Advantageous Alternative Form of the Second Aspect of the Invention

According to an advantageous alternative form of the second aspect of the invention, the collet has at least two levels, and the point of attachment or of insetting of the hairspring (or the points of attachment in the case of a two-blade hairspring) is located on a different level from the level at which the bearing surfaces lie and at a distance from the center of the collet that is less than the distance between the center of the collet and its contour or periphery.

Figure 20:
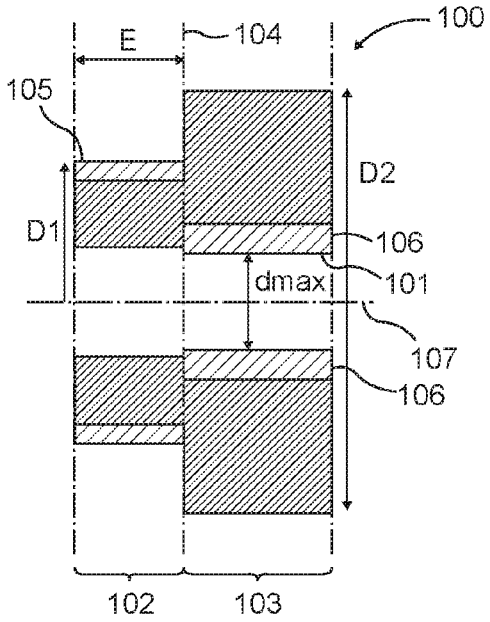

As illustrated in FIG. 20, the collet 100 comprises a bore 101 intended to receive the balance staff, and at least a first part 102 and a second part 103. The first and second parts are separated by a plane 104 perpendicular to the axis 107 of the bore, this axis also representing the center of the collet. The element(s) 105 for attaching the collet to a hairspring are exclusively located on the first part. The element 106 for connecting the collet to the balance staff, for example formed of the bearing surfaces, is essentially, and preferably exclusively, located on the second part. What is meant by "an element for connecting the collet to the balance shaft is essentially located on the second part" is that more than half of the load of connecting the collet to the balance staff is applied in the level of the second part. The bore 101 forms a central opening intended to receive the balance staff.

Figure 19:
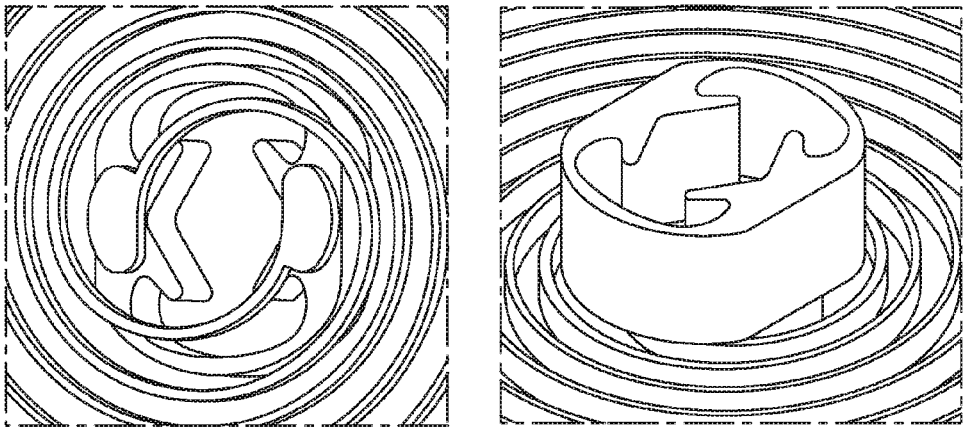

For preference, use is made of an SOI wafer from which to produce such a collet or integrated collet-hairspring assembly including such a collet, the first and second part being made of silicon and separated by a layer of silicon oxide. Specifically, the use of SOI wafers in which the internal layer of $SiO_2$ separating the two layers of Si is thick, or even very thick (for example 2 to 3 microns as usually but preferably with a thickness greater than 5 or even than microns) makes it possible to produce a flexible collet superposing the turns as depicted in FIG. 19, which shows such an integrated double-blade hairspring-collet assembly produced on two levels. The flexible collet is in all respects similar to that of FIG. 4. However, the points of attachment of the hairspring are not located on the contour as they are in FIG. 21 but are located as close as possible to the central opening of the collet and therefore to the balance staff, as in the example of FIG. 22. The blades of the hairspring are thus partially superposed with the collet, over a little under 180° in the example of FIG. 19 (corresponding to a little under half a turn of winding of the blade of the hairspring). The two-level manufacturing method allows this kind of structure to be created because the attack that dissolves the $SiO_2$ (FIG. 8*j*) will also attack the oxide that connects the blades to the collet if the attack time is long enough, thus freeing these blades.

Thus, the element that attaches the hairspring to the collet or the insetting point 10, 11 lies at a distance D1 from the axis of the bore 107 that is less than half the diameter D2 of a cylinder inside which the second part can be inscribed, notably at a distance D1 less than or equal to the mean of half the diameter D2 and half the diameter of the inscribed circle $d_{max}$. This is the case for the hairspring-collet assembly of FIG. 22, in which D1 is equal to 0.330 mm, whereas D2 is equal to 1.180 mm and the mean of half the diameter D2 and of half the diameter of the inscribed circle $d_{max}$ is equal to (1.180 mm/2+0.495 mm/2)/2=0.41875 mm. That is equivalent to positioning the insetting point 10, 11 85 microns distant from the axis in the case of FIG. 22, as opposed to 275 microns away in the case of FIG. 21. Alternatively, the insetting point is closer to the central opening than is the contour 33 of the collet.

A collet as described above may in particular be included in an integrated hairspring-collet assembly.

The fact of bringing the attachment point closer to the balance staff allows a considerable improvement in the time keeping properties. In addition, this type of approach is not restricted to a two-blade hairspring but is also perfectly suited to a single-blade hairspring and is not restricted to a closed-contour collet but is also suitable for a split collet. Any combination of collet and hairspring can be obtained in this way, the effect being a hairspring-collet assembly with markedly improved time keeping properties.

Simulations

Finite element simulations were carried out on two integrated double-blade hairspring-two-part non-split collet assemblies of the kind depicted in FIGS. 9 and 10.

These two similar assemblies A and B are depicted in FIGS. 12 and 13. Their dimensions are comparable in a number of respects: the size is 1.17 mm along the major axis (dimension d in the figures), the distance c is 0.550 mm, inscribed diameter at the center of the opening is 0.495 mm, the angle $\alpha$ is equal to 120°, the radius of curvature of the external contour at the vertex of the flexible connecting parts is 0.538 mm. Only the thickness of the flexible connecting parts differs significantly: if the width at the vertex of the connecting parts (i.e. in their middle, mid-distance from the receiving parts) is denoted b and the minimum width of the connecting parts is denoted e, b=0.085 mm and e=0.050 mm for the collet of FIG. 12 and b'=0.070 mm and e'=0.050 mm for the collet of FIG. 13. The maximum width of the rigid receiving parts a also differs: a=0.224 mm for the collet of FIG. 12 and a'=0.200 mm for the collet of FIG. 13, but the distance between the points of attachment of the double-blade hairspring is identical.

The hairspring layer height (first part) is 150 microns and the layer height of the level bearing the bearing surfaces (second part) is 500 microns.

The balance staffs have a toleranced diameter comprised between 0.5 and 0.506 mm, with a nominal value of 0.503 mm.

Figure 3:
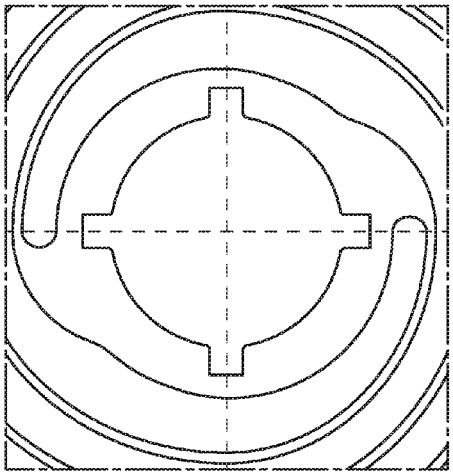
Fig. 3 (Prior art)
FIG. 3 depicts the collet proposed in patent application WO2011026725.

The graph of FIG. 14 shows the change in the simulated retaining torque M of the collet as a function of balance staff diameter for each of the hairspring/collet assemblies of FIGS. 12, 13 and 3 respectively. The minimum retaining torque is indicated in FIG. 14 by the broken line.

It is found for each of the assemblies that the retaining torque is higher than the demanded minimum torque, even for small diameters below the minimum tolerance.

The graph of FIG. 15 shows the change in stress s of the collet as a function of balance staff diameter for each of the hairspring/collet assemblies of FIGS. 12, and 3 respectively. The maximum permissible stress for the material (elastic limit with a factor of safety) is indicated by the broken line.

It is found, for each of the assemblies according to the invention, that the maximum stresses are well below the maximum permitted value. The advantage of the collet of FIG. 13 is that it is more flexible, that its stress level is not as high and that the gradient of torque as a function of staff diameter is shallower than for the collet of FIG. 12. A corollary effect of this is that the retaining torque is lower.

For the assembly according to the prior art however, the stress very soon exceeds the maximum permissible value. It can therefore be seen this type of collet is not suited to a driven push-fit assembly. This is because such a contour geometry does not provide both adequate retention and deformation of the collet without breaking following the driven push-fitting of the balance staff. In addition, the inscribed diameter is only 0.2 of a micron smaller than the lower limit of the tolerance so that the stresses are below the maximum permissible limit for the bottom limit of the tolerance, thus requiring extremely close manufacturing tolerances.

The same behavior is predicted for other collets of the prior art, as depicted in FIG. 10D of document EP 1 655 642. The increase in stress with staff diameter is not as steep as it is in the case of the collet of FIG. 3, but the maximum permissible stress is nonetheless greatly exceeded before the upper limit of the tolerance is reached.

This example illustrates the advantage of a closed contour collet with rigid receiving parts connected by flexible connecting parts. This difference in rigidity can be estimated to a first approximation using the small deformation beam theory: for a beam, the rigidity k of an element of width e, of thickness h and of length L is proportional to $e^3 \times h/L^3$. By making the approximation that the width e is constant along the parts, the ratio between the rigidity of an receiving part, $k_r$, and of a connecting part, $k_f$, is therefore equal to $k_r/k_f=(e_r^3 \times h_r \times L_f^3)/(e_f^3 \times h_f \times L_r^3)=(e_r^3 \times L_f^3)/(e_f^3 \times L_r^3)$, if the thickness is the same. Reducing the mean width of the connecting parts by comparison with the receiving parts and maximizing the length of these same connecting parts thus allows a very significant reduction in the rigidity of the connecting parts. For preference, a ratio $k_r/k_f$ higher than 10, more preferably higher than 50, more preferably still higher than 100, will be chosen.

Given that the rigidity is dependent on the cube of the width, the difference in width between the rigid receiving parts and the flexible connecting parts is preferable for obtaining a lower rigidity on the connecting parts than on the receiving parts.

There are various possible ways of obtaining a lower rigidity: thus, the mean width of the connecting parts may preferably be smaller than the mean width of the receiving parts, more preferably smaller by a factor of two than the mean width of the receiving parts.

Alternatively, or in combination, the two connecting parts have a minimum width and/or a width at mid distance from the receiving parts that is/are smaller than the maximum width of the receiving parts.

The minimum width e of the connecting parts is then preferably less than 0.5×a, more preferably equal to or less than 0.3×a where a is the maximum width of the receiving parts.

Alternatively, or in combination, the width at the middle of the connecting parts, at mid distance from the receiving parts, is preferably less than 0.7×a, more preferably equal to or less than 0.5×a.

The thickness of the receiving parts and of the connecting parts can also be varied, notably by making the connecting parts thinner by comparison with the receiving parts, but it is more favorable to vary the width than the thickness in order to vary the rigidity.

Of course, a person skilled in the art will know to adapt the dimensions of the collet to suit the circumstances, according to the thickness of the hairspring, the space at his disposal, while taking care to ensure sufficient torque withstand and to keep the stresses well below the maximum permissible stress in order to remain in the elastic deformation domain.

The benefit of at least two levels for an integrated hairspring/collet assembly can be explained as follows. For a hairspring/collet assembly with just one layer, the height is determined by the dimensions of the hairspring, amongst other things by the torque required and the size (diameter). The height of the collet, and therefore of the arms bearing the bearing surfaces and the flexible parts, will necessarily be dictated by the height of the hairspring and there will be no freedom to adjust this. For a single layer assembly 150 microns in height, the retaining torque values are lower, by a factor of 500/150 in relation to a multilayer assembly equipped with a hairspring of the same height (150 microns), because it is held over 150 microns rather than over 500 microns. As a result, these retaining torque values will be below the minimum value (broken line in FIG. 14) required for staff diameters close to the bottom end of the tolerance band (0.5 micron).

It is also possible to conceive of having the bearing parts also borne by the level comprising the hairspring, and this in the example mentioned hereinabove would make it possible to increase the retaining torque values to a factor of 650/150 by comparison with an assembly having just one level. However, the tolerances on the manufacturing method make creating continuous surfaces over two levels a very tricky matter. It is therefore preferable to separate the functions of attaching the hairspring and of connecting the collet to the balance shaft between two distinct levels and not have to provide bearing parts on the level that has the element or elements for attaching the collet to the hairspring.

Thus, one way of increasing the retaining torque of a single layer or single stage collet is to increase the torque developed by the flexible parts without increasing the stress, and this entails a larger collet diameter. The consequence of this is that the point of attachment of the blades of the hairspring needs to be further away from the balance staff, impairing time keeping properties.

It is evident from the foregoing that an integrated hairspring/collet assembly having at least two levels, for example two stages of silicon separated by a layer of silicon oxide, offers the possibility of maximizing the retaining torque while optimizing size, i.e. while avoiding increasing the diameter of the collet. A collet in which the second part 103 extends, along the axis of the bore 107, over a length greater than one times the thickness E of the hairspring, or even greater than 3 times the thickness E of the hairspring, is therefore particularly well suited notably to forming an integrated hairspring-collet assembly.

Figure 6:
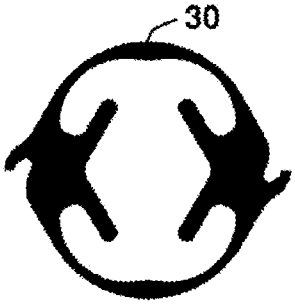
Figure 7:
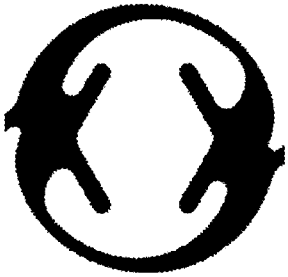

FIGS. 6 and 7 depict alternative forms of the integrated hairspring/collet assembly according to the invention.

FIG. 6 shows that the elastic parts bulge at their center 30 toward the inside of the peripheral recesses.

The two-stage integrated hairspring/collet assembly of FIG. 7 comprises flexible parts which are not symmetric.

The thermal compensation of the hairspring of the single-blade or double-blade hairspring-collet assembly is afforded by known means. It is possible for example to use a layer of material at the surface of the turns which compensates for the first thermal coefficient of the Young's modulus of the base material. In the case of a hairspring made of Si, a suitable material for the layer is $SiO_2$.

For preference, in the various alternative forms and embodiments, each connecting part is mainly loaded in bending, once the integrated assembly has been mounted on the balance staff.

What is meant by "mainly loaded in bending" is that, in each connecting part, it is possible to identify a neutral axis directed substantially in a direction in which the connecting part extends and separating a zone that is loaded in tension from a zone that is loaded in compression.

For preference, in the various alternative forms and embodiments, each connecting part has a portion distant from the balance staff by at least 0.5 times the radius of the balance staff, or even by at least 0.9 times the radius of the balance staff, once the assembly has been mounted on the balance staff.

For preference, in the various alternative forms and embodiments, the receiving parts and the connecting parts form an element able continuously to surround the balance staff, i.e. able without topological interruption to surround the balance staff. They thus form a closed collet, as opposed to a split collet.

In this document, "nondeformable part" or "rigid part" means a part that suffers no or substantially no deformation during operation or during the mounting of the integrated assembly on the balance staff or a part the deformation of which is not required and/or plays no part during operation or during fitting of the integrated assembly.

In this document, a "deformable part" means a part that deforms elastically during operation or during mounting of the integrated assembly on the balance staff or a part the elastic deformation of which is sought after or performs a function during operation or when mounting the integrated assembly.

According to one aspect of the invention, the integrated hairspring-collet assembly comprises:

- a first receiving part intended to bear against a balance staff,
- a second receiving part intended to bear against the balance staff,
- a first connecting part intended to connect the first and second receiving parts, and
- a second connecting part intended to connect the first and second receiving parts.

These various parts are preferably included within a collet.

The invention claimed is:

1. A hairspring-collet assembly comprising (i) a hairspring and (ii) a collet comprising a bore intended to receive a balance staff, at least a first part and a second part, the first and second parts being separated by a plane perpendicular to the axis of the bore, an element for attaching the collet to a hairspring being exclusively located on the first part and an element for connecting the collet to the balance staff being essentially located on the second part, wherein an attachment point of the hairspring to the collet lies at a distance from the center of the collet that is less than half the diameter of a cylinder inside which the second part can be inscribed;

wherein the attachment point is defined as a point at which a local rigidity along a neutral axis of the hairspring reaches a value that is 10 times higher than a minimum value of a local rigidity along the hairspring.

2. The hairspring-collet assembly as claimed in claim 1, in which the attachment point lies at a distance from the center of the collet that is less than or equal to the mean of half the diameter of the cylinder inside which the second part can be inscribed and half the diameter of the inscribed circle inscribed inside a central opening of the collet.

3. The hairspring-collet assembly as claimed in claim 1, in which the second part extends, along the axis of the bore, over a length greater than one time the thickness of the hairspring.

4. An integrated hairspring-collet assembly comprising an element configured to continuously surround a balance staff and comprising:

- a first receiving part configured to bear against the balance staff,
- a second receiving part configured to bear against the balance staff,
- a first connecting part arranged to connect the first and second receiving parts,
- a second connecting part arranged to connect the first and second receiving parts, and
- wherein each of the first and second connecting parts is more deformable than each the first and second receiving part, wherein a radial dimension of each the first and second connecting parts varies along at least a portion of a peripheral length of the connecting part.

5. The integrated assembly as claimed in claim 4, in which each connecting part is configured to be loaded mainly in bending, once the integrated assembly has been mounted on the balance staff.

6. The integrated assembly as claimed in claim 4, in which the receiving parts face one another.

7. The integrated assembly as claimed in claim 4, in which one blade of the hairspring is attached or connected directly to one of the receiving parts.

8. The integrated assembly as claimed in claim 4, in which a central opening of the collet intended to receive a balance staff is non-circular.

9. The integrated assembly as claimed in claim 4, in which the contour of the central opening of the collet comprises, on one same receiving part, at least one bearing surface for the balance staff.

10. The integrated assembly as claimed in claim 4, in which the contour of the central opening of the collet comprises two pairs of bearing surfaces.

11. The integrated assembly as claimed in claim 4, in which the bearing surfaces are at least partially located on arms or extensions extending from the body of the receiving parts.

12. The integrated assembly as claimed in claim 4, in which the various connecting parts have identical geometries and/or the various receiving parts have identical geometries.

13. The integrated assembly as claimed in claim 4, in which the hairspring is a double-blade hairspring comprising a first blade of which the point of attachment to the collet is connected to a first receiving part and a second blade of which the point of attachment to the collet is connected to a second receiving part.

14. The integrated assembly as claimed in claim 4, in which the attachment point(s) of the single-blade or double-blade hairspring is (are) closer to the central opening of the collet than is the contour of the collet.

15. The integrated assembly as claimed in claim 4, the assembly being made of a fragile material or of a material that has no plastic deformation domain.

16. The integrated assembly as claimed in claim 4, the assembly comprising a collet comprising a bore intended to receive a balance staff, at least a first part and a second part, the first and second parts being separated by a plane perpendicular to the axis of the bore, an element for attaching the collet to a hairspring being exclusively located on the first part and an element for connecting the collet to the balance staff being essentially located on the second part.

17. A method of manufacturing an integrated assembly as claimed in claim 16, in which the hairspring is produced on a different part to the part on which the bearing surfaces via which the collet bears against the balance staff lie.

18. A method of manufacturing a hairspring-collet assembly as claimed in claim 1, in which an element for attaching the collet to a hairspring is produced on a different part than the part on which an element for connecting the collet to the balance staff lies.

19. An integrated hairspring-collet assembly made of a material that has no plastic deformation domain, in which:

the contour of the collet is a closed contour, the central opening of the collet which is intended to receive a balance staff is non-circular, the contour of the central opening of the collet comprises at least first and second bearing surfaces for a balance staff; wherein the collet is formed of first and second balance staff receiving parts located facing one another, wherein the first balance staff receiving part comprises at least the first bearing surface for the balance staff as well as an attachment point for the hairspring, and the second balance staff receiving part comprises at least the second bearing surface for the balance staff, and the first and second balance staff receiving parts are connected to one another by two connecting parts which have a lower rigidity than the receiving parts so that they deform elastically as a balance staff is driven in, and a transverse cross-sectional area of at least one portion of each of the connecting part along a peripheral length thereof is smaller than a transverse cross-section area of the respective connecting part at a junction with at least one of the receiving parts at a base of at least one of the first and second bearing surfaces.

20. The integrated hairspring-collet assembly as claimed in claim 19, formed on two levels, the hairspring being located on a different level from the level on which the bearing surfaces for the balance staff lie.

21. An integrated hairspring-collet assembly comprising a hairspring and a collet, wherein the collet has bearing surfaces configured to receive a balance staff, and wherein the hairspring is located on a first level and the bearing surfaces of the collet lie entirely on a second level different from the first level.

22. A timepiece movement or a timepiece comprising an integrated assembly as claimed in claim 4.

23. The integrated hairspring-collet assembly as claimed in claim 21, in which the point(s) of attachment of the single or double blade hairspring is (are) closer to the central opening of the collet than is the contour of the collet.

24. An oscillator comprising an integrated assembly as claimed in claim 19 and a balance staff of circular cross section.

* * * * *